US009126445B1

(12) United States Patent
Spence et al.

(10) Patent No.: US 9,126,445 B1
(45) Date of Patent: Sep. 8, 2015

(54) MODULAR PRINT BAR ASSEMBLY FOR AN INKJET PRINTER

(71) Applicant: Xerox Corporation, Norwalk, CT (US)

(72) Inventors: James J. Spence, Honeoye Falls, NY (US); Mark A. Atwood, Rush, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/251,931

(22) Filed: Apr. 14, 2014

(51) Int. Cl.
*B41J 2/15* (2006.01)
*B41J 25/34* (2006.01)
*B41J 2/14* (2006.01)

(52) U.S. Cl.
CPC .. *B41J 25/34* (2013.01); *B41J 2/14* (2013.01); *B41J 2202/20* (2013.01); *B41J 2202/21* (2013.01)

(58) Field of Classification Search
CPC ..... B41J 25/00; B41J 25/001; B41J 25/003; B41J 25/005; B41J 25/304; B41J 25/308
See application file for complete search history.

(56) References Cited

U.S. PATENT DOCUMENTS

| | | | | |
|---|---|---|---|---|
| 5,469,199 | A | 11/1995 | Allen et al. | |
| 6,123,410 | A | 9/2000 | Beerling et al. | |
| 6,250,738 | B1 | 6/2001 | Waller et al. | |
| 6,322,206 | B1 | 11/2001 | Boyd et al. | |
| 7,669,965 | B2 | 3/2010 | Silverbrook | |
| 7,918,533 | B2 | 4/2011 | Silverbrook et al. | |
| 8,556,386 | B2 | 10/2013 | Silverbrook et al. | |
| 2012/0019592 | A1* | 1/2012 | Chang | 347/37 |

* cited by examiner

*Primary Examiner* — Geoffrey Mruk
(74) *Attorney, Agent, or Firm* — Maginot Moore & Beck LLP

(57) ABSTRACT

A modular printhead assembly facilitates the manufacture of printers with print zones of differing widths. The printhead assembly includes a pair of end pieces and a plurality of rods that extend between the end pieces in parallel. The rods pass through holes in lugs extending from carriers configured for the mounting of printheads. Plates are interposed between the printheads and the carriers to enable actuators to move the plates and printheads within the perimeters of the carriers to adjust the stitch and roll alignments of the printheads.

20 Claims, 13 Drawing Sheets

MODULAR PRINT BAR ASSEMBLY FOR AN INKJET PRINTER

TECHNICAL FIELD

This disclosure relates generally to inkjet imaging devices, and, in particular, to print bar assemblies in inkjet printers.

BACKGROUND

In general, inkjet printers include a plurality of printheads that are mounted to a print bar assembly frame. The frame is a unitary die cast structure having two sides with a plurality of bars or rods extending in parallel between the sides. Printheads are then mounted to carriers, which are mounted to the bars at particular positions to provide the appropriate pixel resolution for images generated by the printer. A print zone of a printer is the area within a printer where an ink image is formed for media passing through the printer. In some standard size printers, the print bar assembly is formed to produce images with an 8.5 inch, 24 inch, 36 inch, or 40 inch width. Each different image width requires a different die cast frame. These die cast frames are quite expensive and cannot be adapted to any width other than the print zone width for which the frame was cast. Having print bar assemblies that can be modified to accommodate different image widths would be beneficial.

SUMMARY

In one embodiment a printer includes a print bar assembly that enables the assembly to be built with different widths without having to obtain different die cast frames. The printer includes a media transport configured to move media through the printer to form an ink image on the media, a first member having three linearly arranged receptacles, a second member having three linearly arranged receptacles, a first rod, a second rod, and a third rod. Each rod has a first end and a second end, the first end of each rod being positioned within one of the receptacles in the first member in a one-to-one correspondence and the second end of each rod being positioned within one of the receptacles in the second member in a one-to-one correspondence to enable the first, the second, and the third rods to extend parallel to one another from the first member to the second member. The printer also includes a first frame having a perimeter, a pair of flanges extending from a first side of the first frame and a third flange extending from a second side of the first frame, the second side of the first frame being opposite the first side of the first frame, each flange extending from the first frame having a hole in the flange, the first rod passing through the holes in the pair of flanges of the first frame and the second rod passing through the hole in the third flange of the first flange. A second frame in the printer has a perimeter, a pair of flanges extending from a first side of the second frame and a third flange extending from a second side of the second frame, the second side of the second frame being opposite the first side of the second frame, each flange extending from the second frame having a hole in the flange, the third rod passing through the hole in the third flange of the second frame and the second rod passing through the holes in the pair of flanges of the second frame. A first printhead is mounted within the first frame, and a second printhead is mounted within the second frame. A controller is operatively connected to the first printhead and the second printhead, and is configured to operate the first printhead and the second printhead to form the ink image for the media.

The manufacture of printhead assemblies for producing images of different widths has been facilitated by a modular print bar assembly. The modular print bar assembly includes a first member having three linearly arranged receptacles, a first actuator mounted to the first member between two of the linearly arranged receptacles and a second actuator mounted to the first member between two of the linearly arranged receptacles. The first actuator and the second actuator are not mounted between the same two linearly arranged receptacles. The assembly also includes a second member having three linearly arranged receptacles, and a first rod, a second rod, and a third rod. Each rod has a first end and a second end, the first end of each rod being detachably positioned within one of the receptacles in the first member in a one-to-one correspondence and the second end of each rod being detachably positioned within one of the receptacles in the second member in a one-to-one correspondence to enable the first, the second, and the third rods to extend parallel to one another from the first member to the second member.

DETAILED DESCRIPTION

Figure 1:
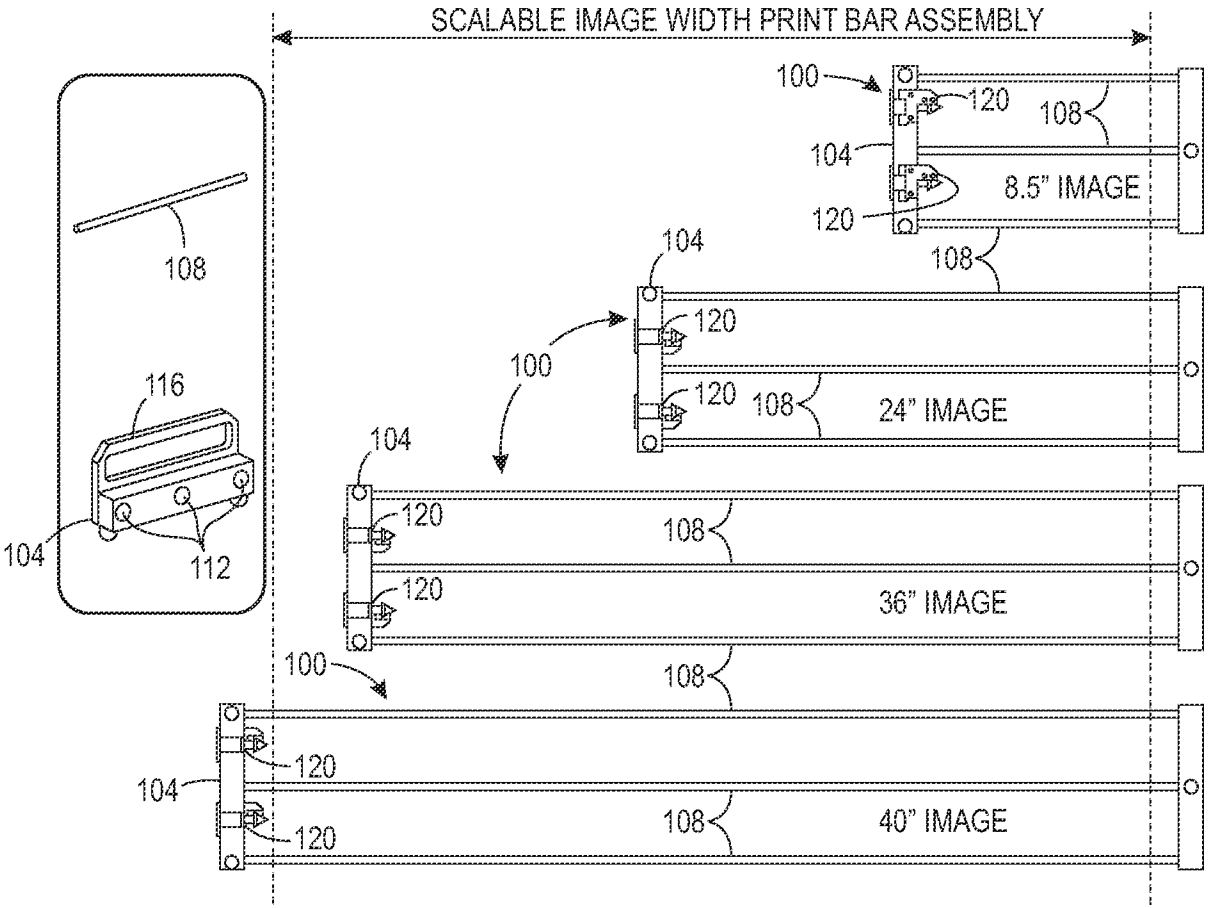
FIG. 1 is a depiction of the components of a modular print bar assembly and the different configurations that can be achieved with the modular print bar assembly.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form that are rendered and used to operate inkjet ejectors in one or more printheads to form an ink image on the print media. These data may include text, graphics, pictures, and the like. The operation of producing images with colorants on print media, for example, graphics, text, photographs, and the like, is generally referred to herein as printing or marking.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

In an indirect printer, the printheads eject ink drops onto the surface of an intermediate image receiving member, for example, a rotating drum or an endless belt. A transfix roller is selectively positioned against the intermediate image receiving member to form a transfix nip. As a media sheet passes through the transfix nip in synchronization with the ink image on the intermediate image receiving member, the ink image transfers and fixes to the media sheet under pressure and heat in the transfix nip. The transfer and fixation of the ink image are well known to the art and are referred to as a transfix process.

In a direct printer, the printheads eject ink drops directly onto a print medium, for example, a paper sheet or a continuous media web. After ink drops are printed on the print medium, the printer moves the print medium through a nip formed between two rollers that apply pressure and, optionally, heat to the ink drops and print medium. One roller, typically referred to as a "spreader roller" contacts the printed side of the print medium. The second roller, typically referred to as a "pressure roller," presses the media against the spreader roller to spread the ink drips and fix the ink to the print medium.

Figure 12:
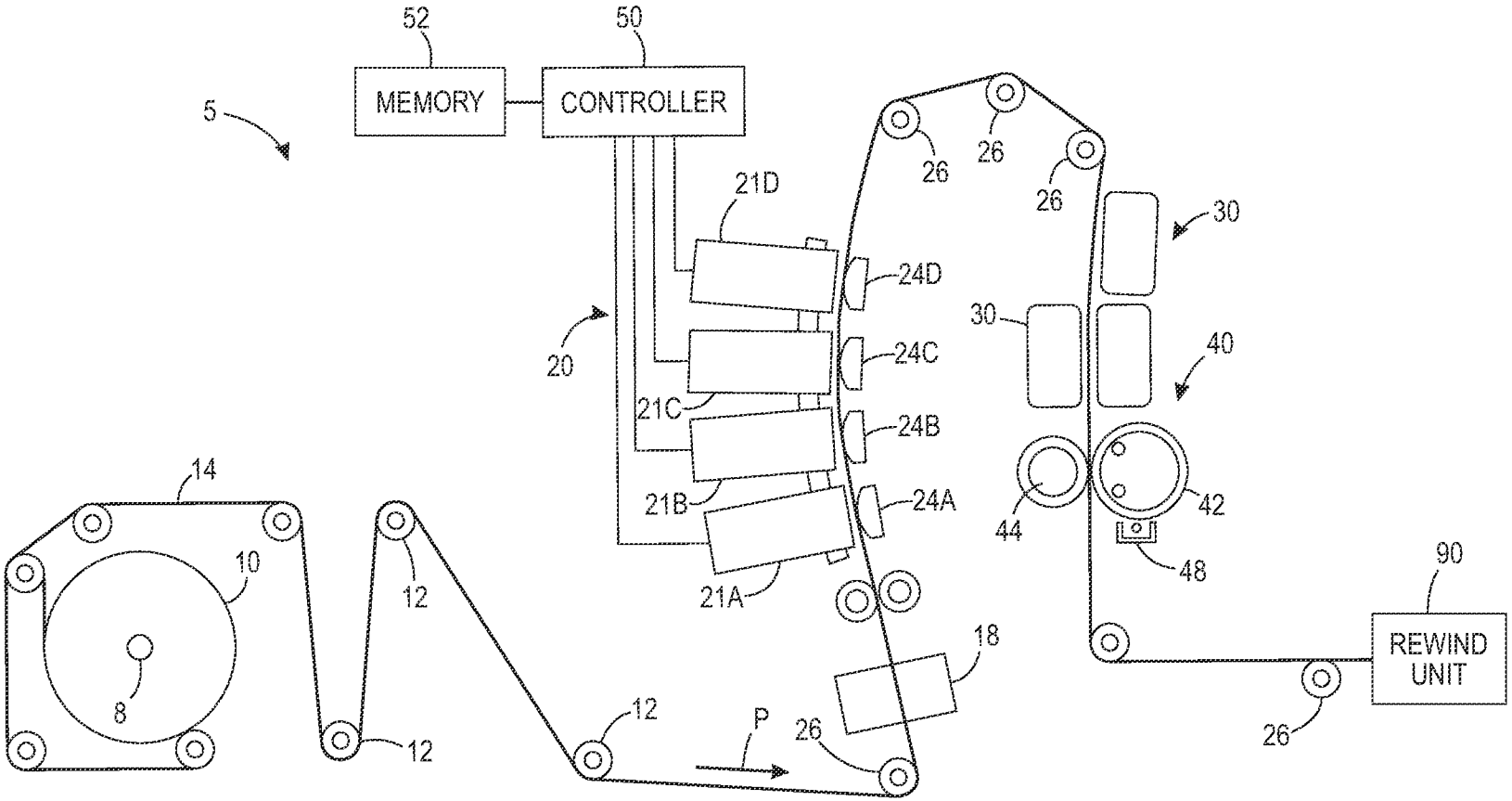
FIG. 12 PRIOR ART
FIG. 12 is a schematic diagram of a prior art continuous direct-to-media printer.

For a general understanding of the environment for the system and method disclosed herein as well as the details for the system and method, reference is made to the drawings. In the drawings, like reference numerals have been used throughout to designate like elements. FIG. 12 depicts a prior-art inkjet printer 5. For the purposes of this disclosure, an inkjet printer employs one or more inkjet printheads to eject drops of ink onto a surface of an image receiving member, such as paper, another print medium, or an indirect member, such as a rotating image drum or belt. The printer 5 is configured to print ink images with a liquid ink. As used herein, liquid ink refers to melted solid ink, heated gel ink, aqueous inks, ink emulsions, ink suspensions, ink solutions, or the like.

The printer 5 includes a controller 50 to process the image data before generating the control signals for the inkjet ejectors to eject colorants. Colorants can be ink or any suitable substance, which includes one or more dyes or pigments and is applied to an image receiving surface to form an ink image. The colorant can be black or any other desired color, and some printer configurations apply a plurality of different colorants to the media. The ink image can be formed on or transferred to media, which includes any of a variety of substrates, including plain paper, coated paper, glossy paper, or transparencies, among others, and the media can be available in sheets, rolls, or other physical formats.

The printer 5 is an example of a direct-to-web, continuous-media, inkjet printer that includes a media supply and handling system configured to supply a long (i.e., substantially continuous) web of media 14 of "substrate" (paper, plastic, or other printable material) from a media source, such as spool of media 10 mounted on a web roller 8. The media web 14 includes a large number (e.g. thousands or tens of thousands) of individual pages that are separated into individual sheets with commercially available finishing devices after completion of the printing process.

The printer 5 includes a media transport using one or more actuators, such as electric motors, to rotate rollers that are arranged along the media path that move the media web 14 in the process direction P at a predetermined linear velocity. In the printer 5, the media web 14 is unwound from the source 10 as needed and a variety of motors, not shown, rotate one or more rollers 12 and 26 to propel the media web 14 in direction P. The media conditioner includes rollers 12 and a pre-heater 18. The rollers 12 and 26 control the tension of the unwinding media as the media moves along a path through the printer. In alternative embodiments, the printer transports a cut sheet media through the print zone in which case the media supply and handling system includes any suitable device or structure to enable the transport of cut media sheets along a desired path through the printer. The pre-heater 18 brings the web to an initial predetermined temperature that is selected for desired image characteristics corresponding to the type of media being printed as well as the type, colors, and number of inks being used.

The media web 14 continues in direction P through the print zone 20 past a series of print bar assemblies 21A, 21B, 21C, and 21D. Each of the print bar assemblies 21A-21D effectively extends across the width of the media and includes one or more printheads that eject ink directly (i.e., without use of an intermediate or offset member) onto the media web 14. In printer 5, each of the printheads ejects a single color of ink, one for each of the colors typically used in color printing, namely, cyan, magenta, yellow, and black (CMYK).

The controller 50 of the printer 5 receives velocity data from encoders mounted proximately to the rollers positioned on either side of the portion of the path opposite the four printheads to calculate the linear velocity and position of the web as the web moves past the printheads. The controller 50 uses the media web velocity data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to digital data processed by the controller 50. The digital data for the images to be printed can be transmitted to the printer, generated by a scanner (not shown) that is a component of the printer, or otherwise generated and delivered to the printer.

Associated with each print bar assembly is a backing member 24A-24D, typically in the form of a bar or roll, which is arranged substantially opposite the corresponding print bar assembly on the back side of the media. Each backing member positions the media at a predetermined distance from the print bar assembly opposite the backing member. The various backer members can be controlled individually or collectively.

Following the print zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40.

Following the mid-heaters 30, a fixing assembly 40 applies heat and/or pressure to the media to fix the images to the media. The fixing assembly includes any suitable device or apparatus for fixing images to the media including heated or unheated pressure rollers, radiant heaters, heat lamps, and the like. In the embodiment of the FIG. 5, the fixing assembly includes a "spreader" 40, which applies a predetermined pressure, and in some implementations, heat, to the media. The function of the spreader 40 is to flatten the individual ink droplets, strings of ink droplets, or lines of ink on web 14 and flatten the ink with pressure and, in some systems, heat. The spreader flattens the ink drops to fill spaces between adjacent drops and form uniform images on the media web 14. The spreader 40 includes rollers, such as image-side roller 42 and pressure roller 44, to apply heat and pressure to the media.

The spreader 40 can include a cleaning/oiling station 48 associated with image-side roller 42. The station 48 cleans and/or applies a layer of some release agent or other material to the roller surface. The release agent material can be an amino silicone oil having viscosity of about 10-200 centipoises. A small amount of oil transfers from the station to the media web 14, with the printer 5 transferring approximately 1-10 mg per A4 sheet-sized portion of the media web 14.

In printer 5, the controller 50 is operatively connected to various subsystems and components to regulate and control operation of the printer 5. The controller 50 is implemented with general or specialized programmable processors that execute programmed instructions. The instructions and data required to perform the programmed functions are stored in a memory 52 that is associated with the controller 50. The memory 52 stores programmed instructions for the controller 50.

In the controller 50, the processors, their memories, and interface circuitry configure the controllers and/or print zone to perform the printer operations. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The controller 50 is operatively connected to the printheads in the printhead units 21A-21D. The controller 50 generates electrical firing signals to operate the individual inkjets in the printhead units 21A-21D to eject ink drops that form printed images on the media web 14.

In the previously known printers, such as the prior art printer 5 shown in FIG. 1, the printheads were mounted onto die cast units as noted above and these assemblies could not be configured for different widths of print zones. A new printhead module has been developed that is scalable to enable the width of the print bar to correspond to any number of printheads. Thus, the print bar assembly can be anywhere from one to N printheads provided the rods 108 are long enough to accommodate N printheads. Such a print bar assembly 100 is shown in FIG. 1. The assembly 100 is comprised of end members 104 and at least three rods 108. Each end member 104 includes three linearly arranged receptacles 112 that are configured to receive an end of one of the rods 108. An actuator 120 is positioned between two consecutive receptacles 112 in one of the end members 104. These actuators, as described below, are configured to adjust a stitch position of the print bar. End members 104 also include a handle 116 to facilitate the mounting of a print bar assembly to a frame in a printer. The rods 108 are precision cut steel rods, such as the Thomson 60 Case® Standard Shafts available from Thomson Industries, Inc. of Radford, Va., although other sources and metals can be used to form the rods. These shafts are cut to predetermined lengths to enable the end members and three rods to be assembled as shown in FIG. 1 to form a print bar assembly. As used in this document, a "frame" refers to a structure having a perimeter and an opening into which another object can be mounted or fitted. As used in this document, a "plate" refers to any structure that supports another object. Also, as used in this document, a "rod" or "bar" refers to an elongated member having two ends and a generally uniform cross-section between the two ends.

Figure 2A:
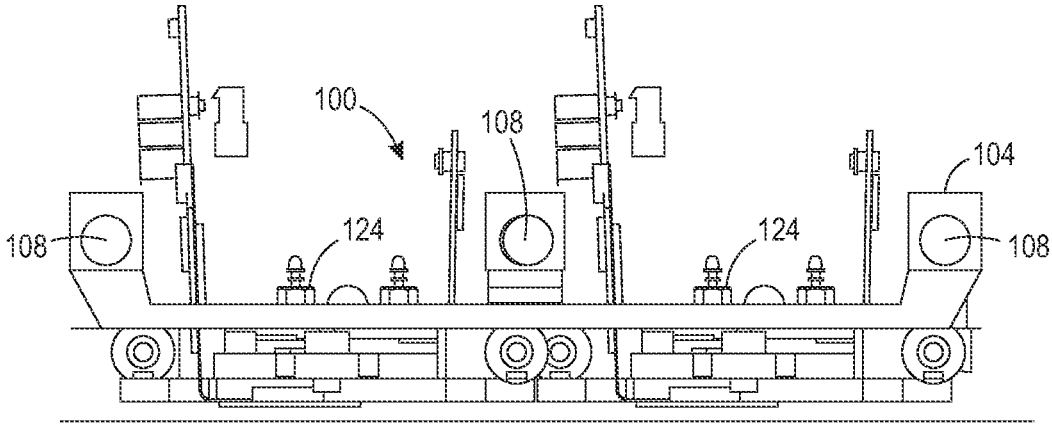
FIG. 2A is a side view of an end member of a modular print bar assembly used in a cut sheet printer or an endless belt intermediate printer.
Figure 2B:
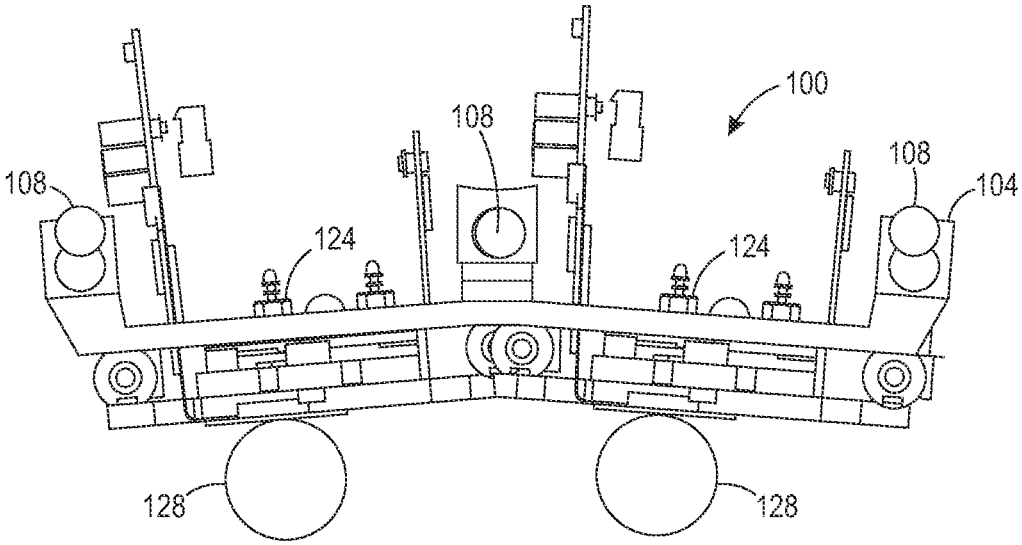
FIG. 2B is a side view of an end member of a modular print bar assembly used in a web printer or a rotating drum intermediate printer.

FIG. 2A is a side view of a print bar assembly 100 with two printheads 124 mounted to the assembly. This print bar assembly is configured for use in a cut sheet printer. Consequently, the printheads 124 eject ink onto a relatively flat media surface. To form the assembly to hold the printheads at an appropriate gap from the relatively flat media surface, the end member 104 has a straight, horizontal profile. FIG. 2B is also a side view of a print bar assembly 100 with two printheads 124 mounted to the assembly. This print bar assembly is configured for use in a web printer, such as the one shown in FIG. 5. Consequently, the printheads 124 eject ink onto a media surface curved by the backer rollers 128. To form the assembly to hold the printheads at an appropriate gap from the curved media surface, the end member 104 is angled from the center of the member outwardly towards the two ends of the member. Consequently, end members 104 configured for cut sheet printers or endless belt intermediate printers have a flat, horizontal side profile as shown in FIG. 2A, while end members 104 configured for web printers or rotating drum intermediate printers have a double canted profile as shown in FIG. 2B.

Figure 3:
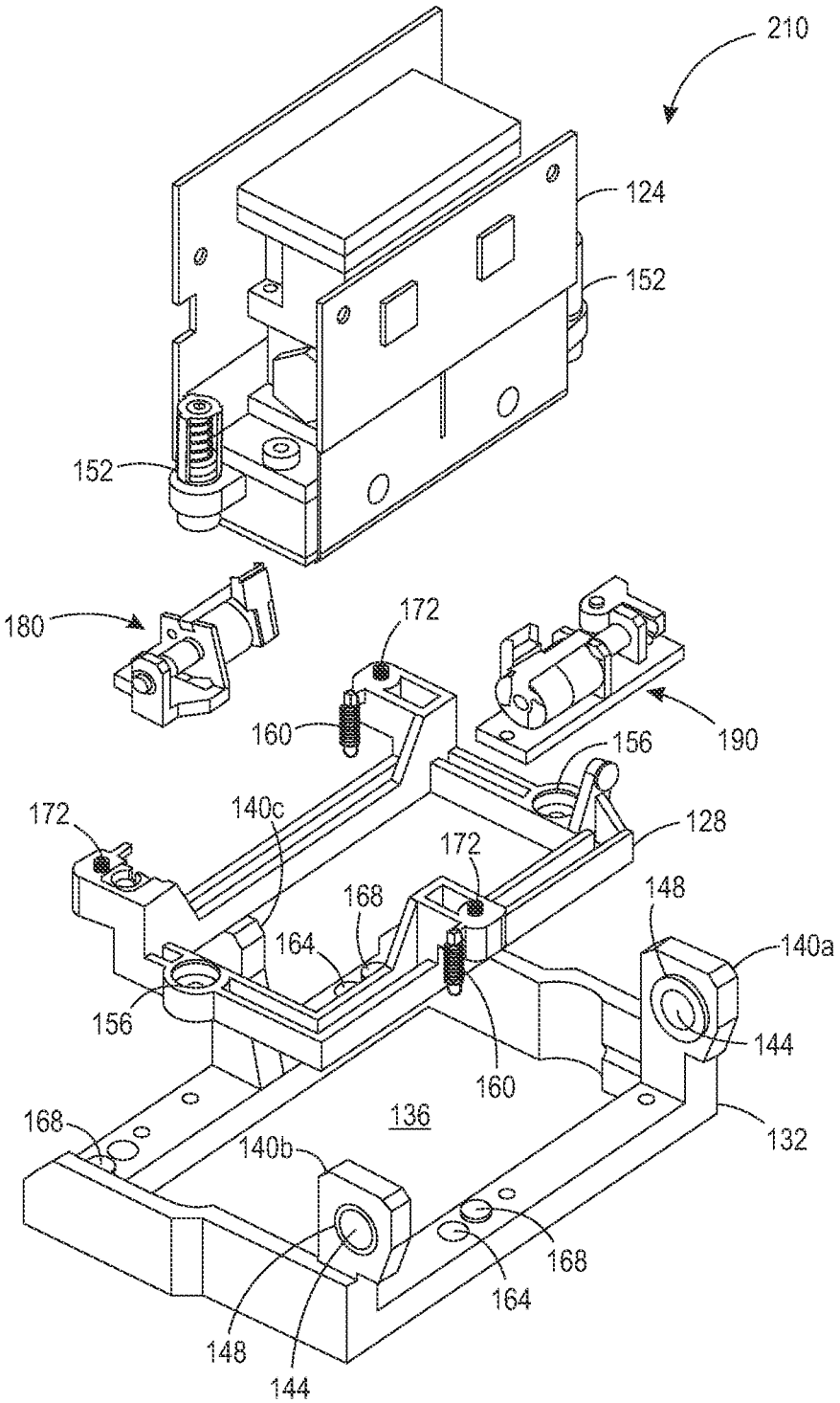
FIG. 3 is an exploded view of a printhead assembly configured to be mounted to the print bar assembly of FIG. 1.

An exploded view of a modular system for mounting a printhead to a print bar assembly is shown in FIG. 3. The system includes a printhead 124, a printhead plate 128, a frame 132, a stitch control mechanism 180, and a roll control mechanism 190. The frame 132, which is made of aluminum, has an opening 136 around which a perimeter of the frame is formed. Three flanges 140*a*, 140*b*, and 140*c* extend from the frame 132. Two flanges 140*a*, 140*b* extend from one side of the frame 132 and each flange has a bushing 148 with an opening 144 that is precision fit onto one of the rods 108. The third flange 140*c* extends from an opposite side of the frame 132 and has a bushing 150 with a slotted bore (FIG. 4). The third flange 140*c* is approximately at the middle of the side of the frame 132 from which it extends, while the other two flanges 140*a*, 140*b* are positioned near the ends of the side of frame 132 from which they extend. This three point configuration helps prevent the frame 132 from binding on the two rods 108 to which the frame is mounted, as described below, when the frame 132 slides on the rods 108. Alternatively, four flanges, one at each corner of the frame, could be used to mount the frame to the rods. The slotted bushing 150 mounted within the flange 140*c* provides larger tolerances for shaft-toshaft spacing and enables the flanges on the frame to expand and contract without affecting shaft alignment under changing thermal conditions within a printer.

Figure 6:
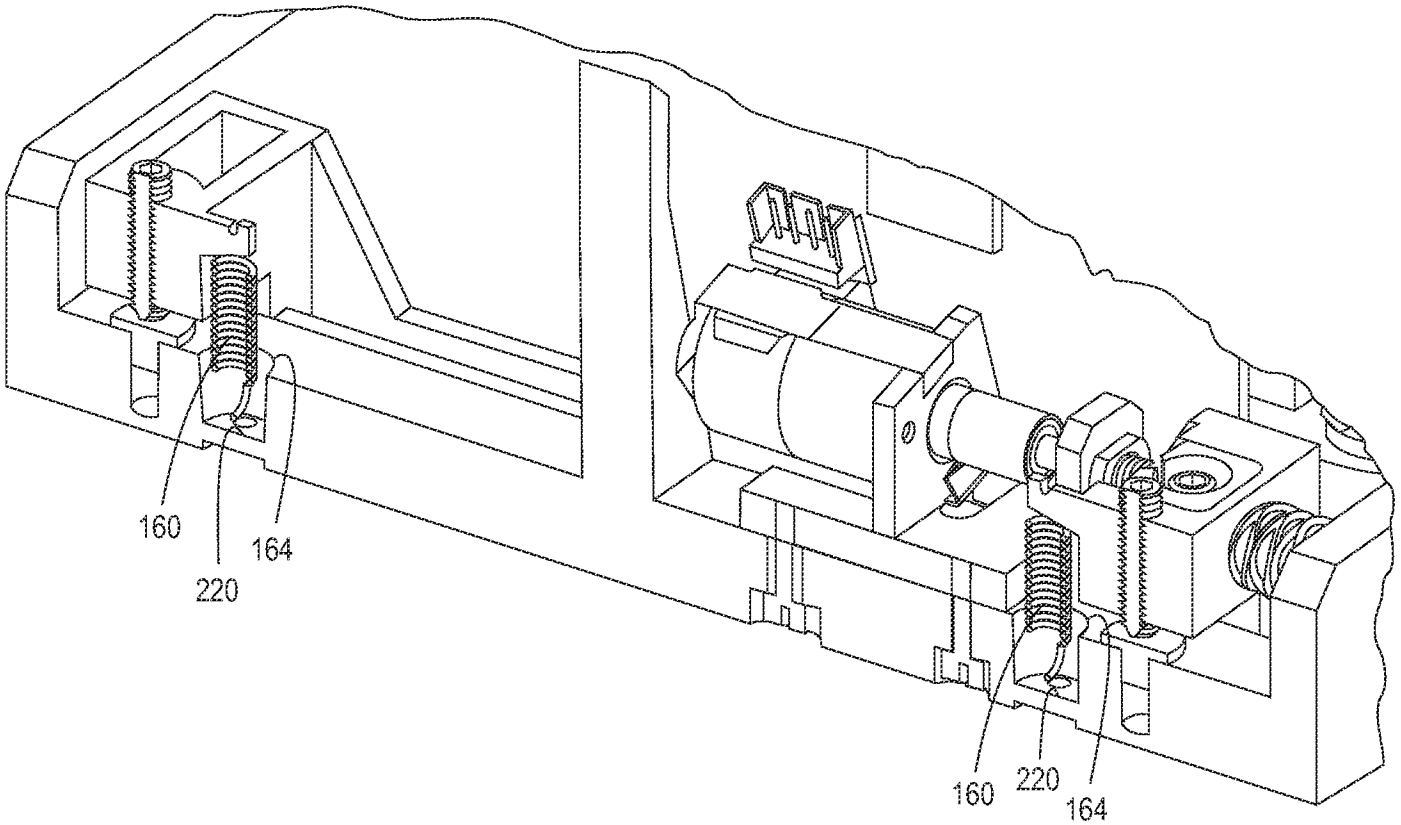
FIG. 6 is a cross-sectional view of the printhead plate and frame taken along lines 6-6 in FIG. 4.

The printhead 124 is mounted to the printhead plate 128 by two spring-loaded screws 152 provided on opposite sides of the printhead. These screws 152 are received within threaded receptacles 156 in the printhead plate 128. The printhead plate 128, which is also made of aluminum, is attached to the frame 132 by biasing members 160, such as the springs shown in FIG. 3. These biasing members 160 extend through holes 164 in the frame 132 and attach to an underside of the frame 132. As shown in FIG. 6, one end of each biasing member 160 engages a hole in a ledge 220 in each of the holes 164. Once the biasing members 160 are attached to the ledges 220 in the holes 164, the biasing members 160 urge the printhead plate 128 into contact with the frame 132. Landing pads 168 are made of hardened steel and are positioned on the upper surface of the frame 132 to be opposite threaded members 172, such as set screws, in printhead plate 128. Once the printhead plate 128 is attached to the frame 132 by the biasing members 160, the ends of the threaded members 172 are turned to contact the pads 168 and level the plate 128 and the printhead 124 with reference to the frame 132.

Figure 4A:
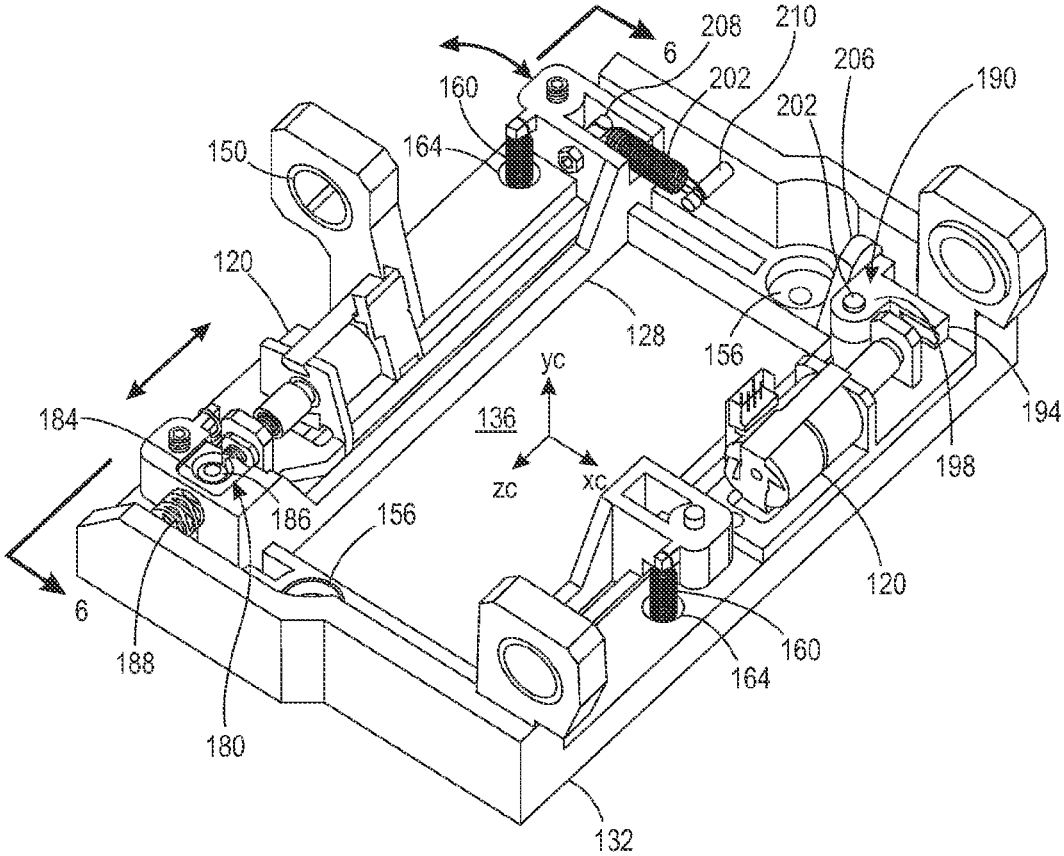
FIG. 4A is a perspective view of a printhead plate mounted to a frame configured for mounting to the print bar assembly of FIG. 1.

FIG. 4A shows the plate 128 attached to the frame 132 by the biasing members 160 passing through the holes 164 in the frame. A stitch control mechanism 180 (FIGS. 4A and 4B) is positioned on the frame 132 to move the plate 128 and the printhead 124 in a bi-directional manner within a length of the opening 136. The mechanism 180 includes an actuator 120 having an output shaft 182 that engages a block 184, which has a V-shaped notch into which the pointed end of shaft 182 fits. The block 184 is secured to the plate 128 by a screw 186. A biasing member 188 is positioned between the block 184 and a side of frame 132. This biasing member 188 urges block 184 towards the end of the output shaft 182 of the actuator 120 so the block 184 and the output shaft 182 remain in contact with one another. Consequently, as a controller operates the actuator 120 to move the output shaft into and out of the actuator, the distance d between the frame 132 and the plate 128 changes. The change in this distance moves the plate and the printhead in the directions indicated by the double-headed arrow adjacent the stitch control mechanism 180 shown in the figure.

Figure 4B:
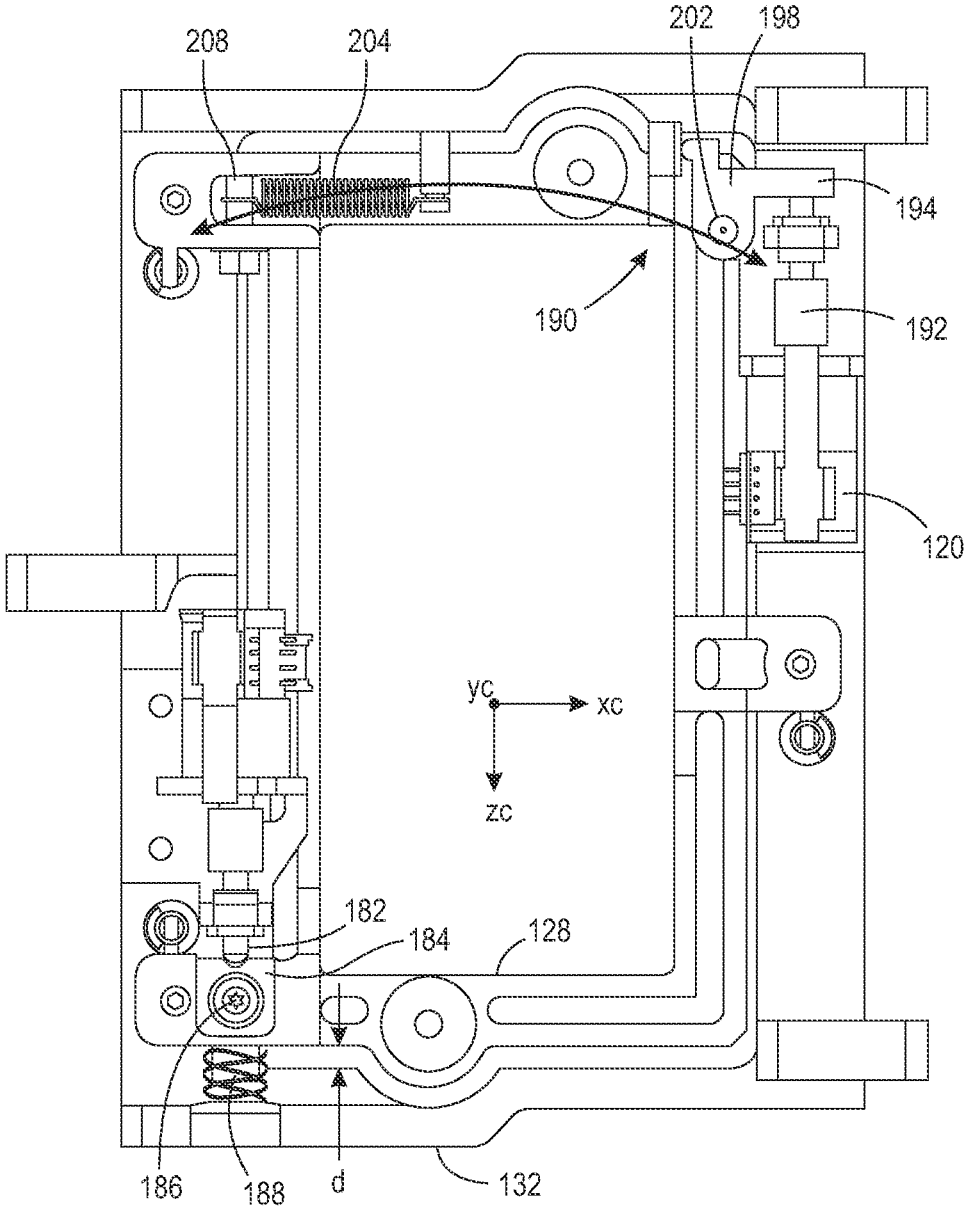
FIG. 4B is a top view of a printhead plate mounted to a frame shown in FIG. 4A.

At the opposite corner of the frame 132 on a diagonal from the stitch control mechanism 180 shown in FIG. 4A and FIG. 4B is a roll control mechanism 190. The mechanism 190 rotates the plate 128 and the printhead 124 in the zc-xc plane. The mechanism 190 includes an actuator 120 having an output shaft with a flat end that engages an arm 194 of a pivoting member 198, which pivots about pin 202 extending from a platform to which the actuator 120 is mounted. A biasing member 204 extends between a bolt 208 in plate 128 and a notched pin 210 in frame 132 to urge plate 128 towards the pivoting member 198 throughout the range of motion of the pivoting member 198. This configuration enables the plate 128 to rotate about the screw 186 while the pivoting member 198, the arm 194, and the output shaft of the actuator 120 remain in contact with one another as the actuator moves the pivoting member 198 through its range of motion. Consequently, as a controller operates the actuator 120 to move the output shaft 192 into and out of the actuator, the arm 194 rotates the pivoting member 198 about the pin 202 causing the plate 128 to rotate about the screw 186 in the double-headed rotational direction shown in FIG. 4A and FIG. 4B.

Figure 5:
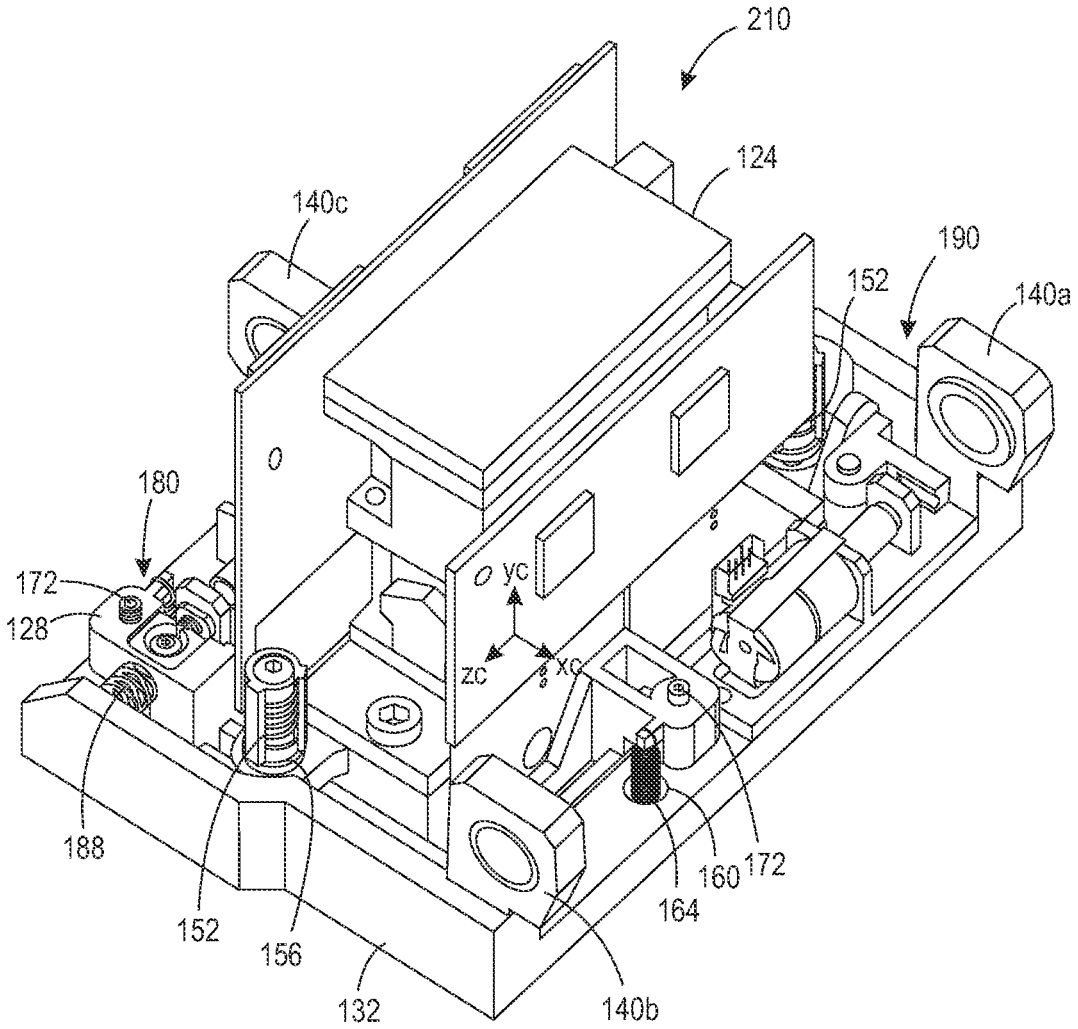
FIG. 5 is a perspective view of a printhead mounted to a printhead plate and frame configured for mounting to the print bar assembly of FIG. 1.
Figure 7:
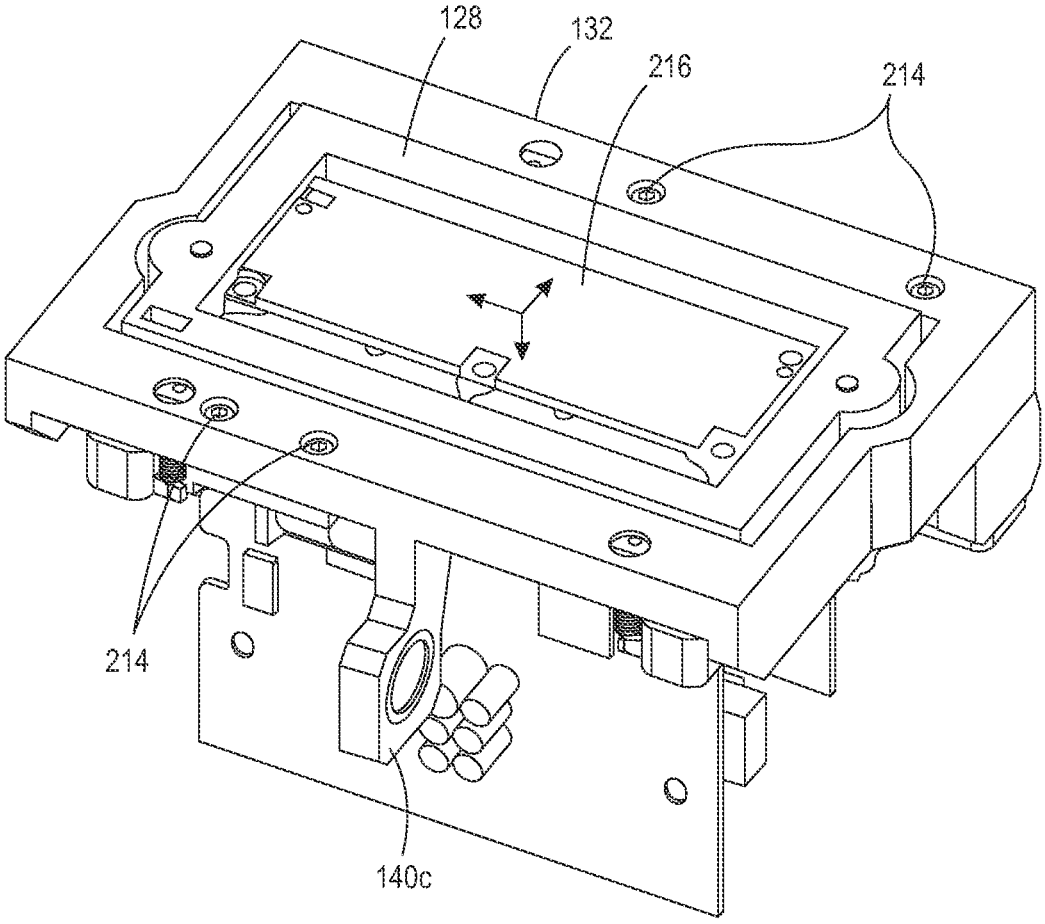
FIG. 7 is a perspective view of the assembly shown in FIG. 5 from an opposite side.

The assembly 210 of the printhead 124, printhead plate 128, and the frame 132 is shown in FIG. 5. The printhead 124 is secured to the printhead plate 128 by the threaded members 152 and the printhead plate 128 is mounted to the frame 132 by the biasing members 160, only one of which is visible in FIG. 5. Threaded members 172 are then manipulated to level a face 216 (FIG. 7) of the printhead 124. Stitch control mechanism 180 and roll control mechanism 190 can be used to position the printhead 124 within the opening 136 for proper stitch and roll alignment, respectively, with other printheads mounted to a print bar assembly 100 as described below. The assembly 210 is shown from the opposite side in FIG. 7. In this view, the face 216 of the printhead is visible as well as the cap screws 214 that are used to engage and secure the platforms to which the stitch control mechanism 180 and the roll control mechanism 190 are mounted. The printhead face 216 is recessed with respect to the plate 128 as is the frame 132 as well.

Figure 8:
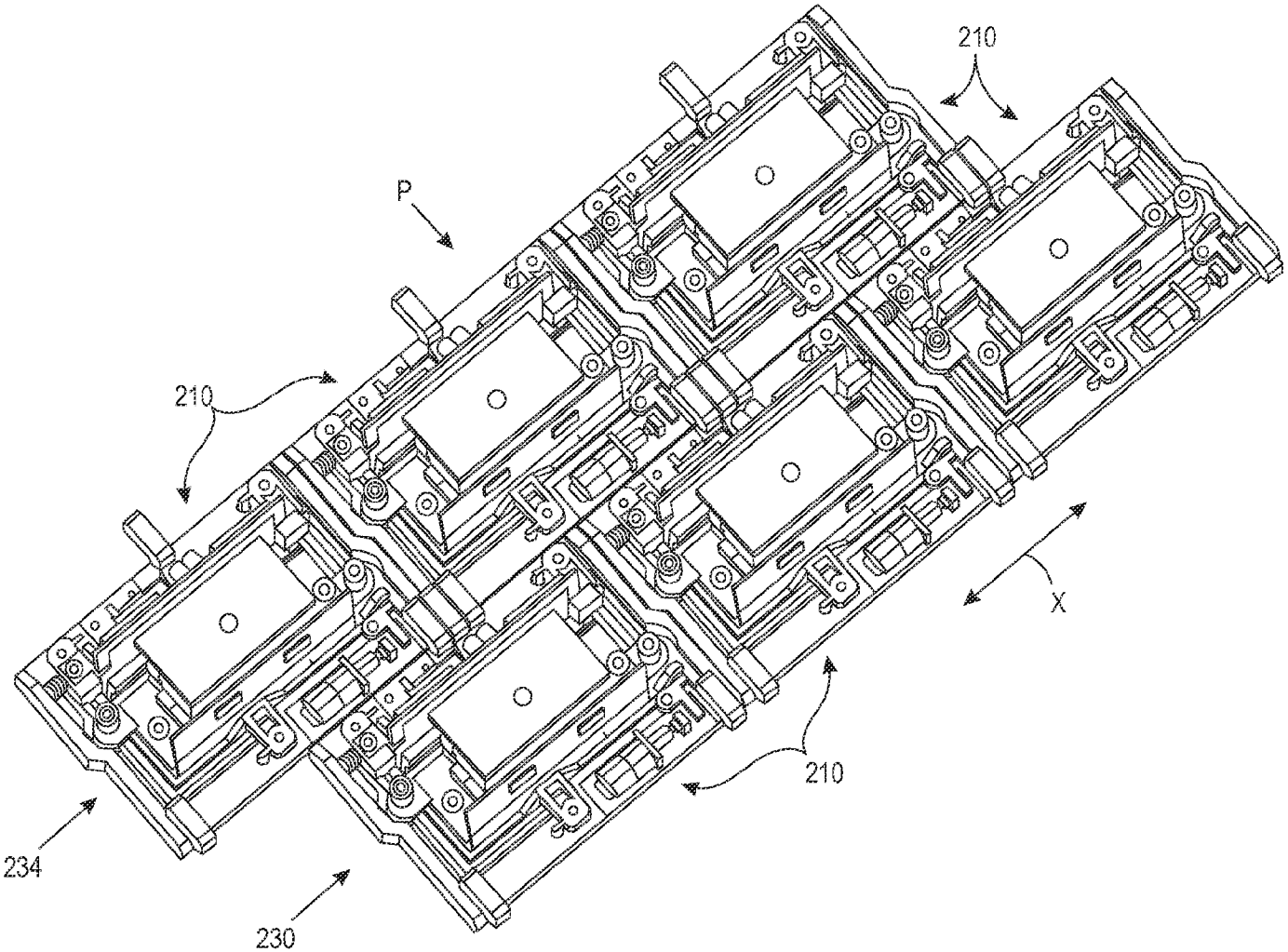
FIG. 8 is a perspective view of an arrangement of printhead assemblies that can be supported by the print bar assembly of FIG. 1.
Figure 9:
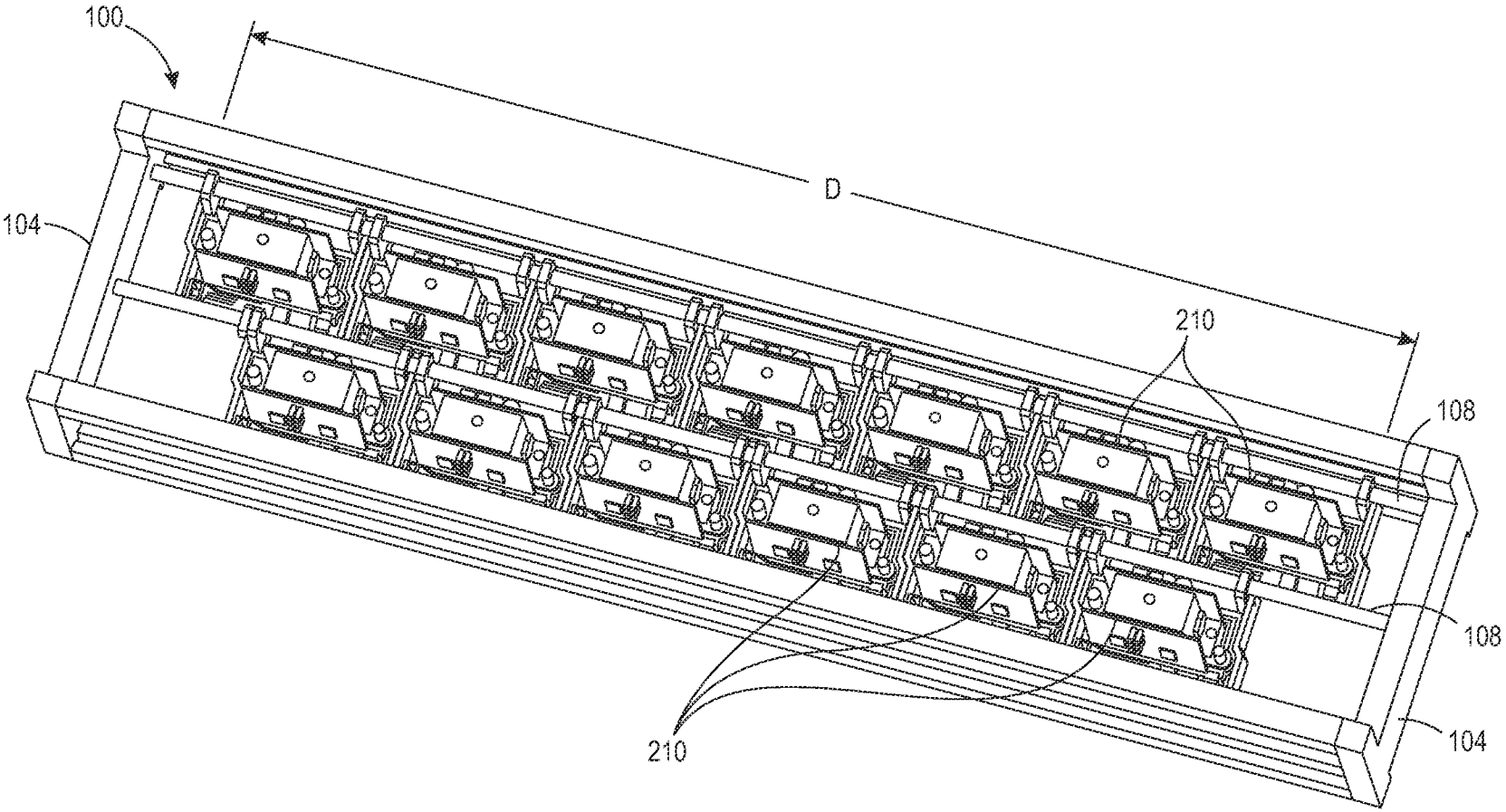
FIG. 9 is a perspective view of the arrangement of printhead assemblies shown in FIG. 8 supported by one of the print bar assemblies shown in FIG. 1.

FIG. 8 shows an arrangement of six assemblies 210 in a staggered array to enable a printer to print a continuous line in a cross-process direction X of a print zone. The surface being printed moves in the process direction P. The arrangement of stitching printheads shown in FIG. 8 is known, but the structure of the assemblies 210 and the structure of the assembly 100 enable modular formation of a print zone heretofore unknown. In this staggered modular arrangement, the third flange 140*c* of each assembly 210 in row 230 is sandwiched between a flange 140*a* of one assembly 210 in row 234 and a flange 140*b* of another assembly in row 234. Thus, as is described below, the middle rod 108 of an assembly 100 can pass through the flanges of the assemblies in both rows 230 and 234 to conjoin the assemblies 210. One of the other remaining rods 108 passes through the flanges 140*c* of the assemblies 210 in row 234 and the other rod 108 passes through flanges 140*a* and 140*b* of the assemblies 210 in row 230. Thus, the length of the rods 108 determine the number of assemblies 210 that can be used to form a printhead array and the width D of an ink image in the cross-process direction. Such an arrangement of assemblies 210 on an assembly 100 is shown in FIG. 9.

Figure 10:
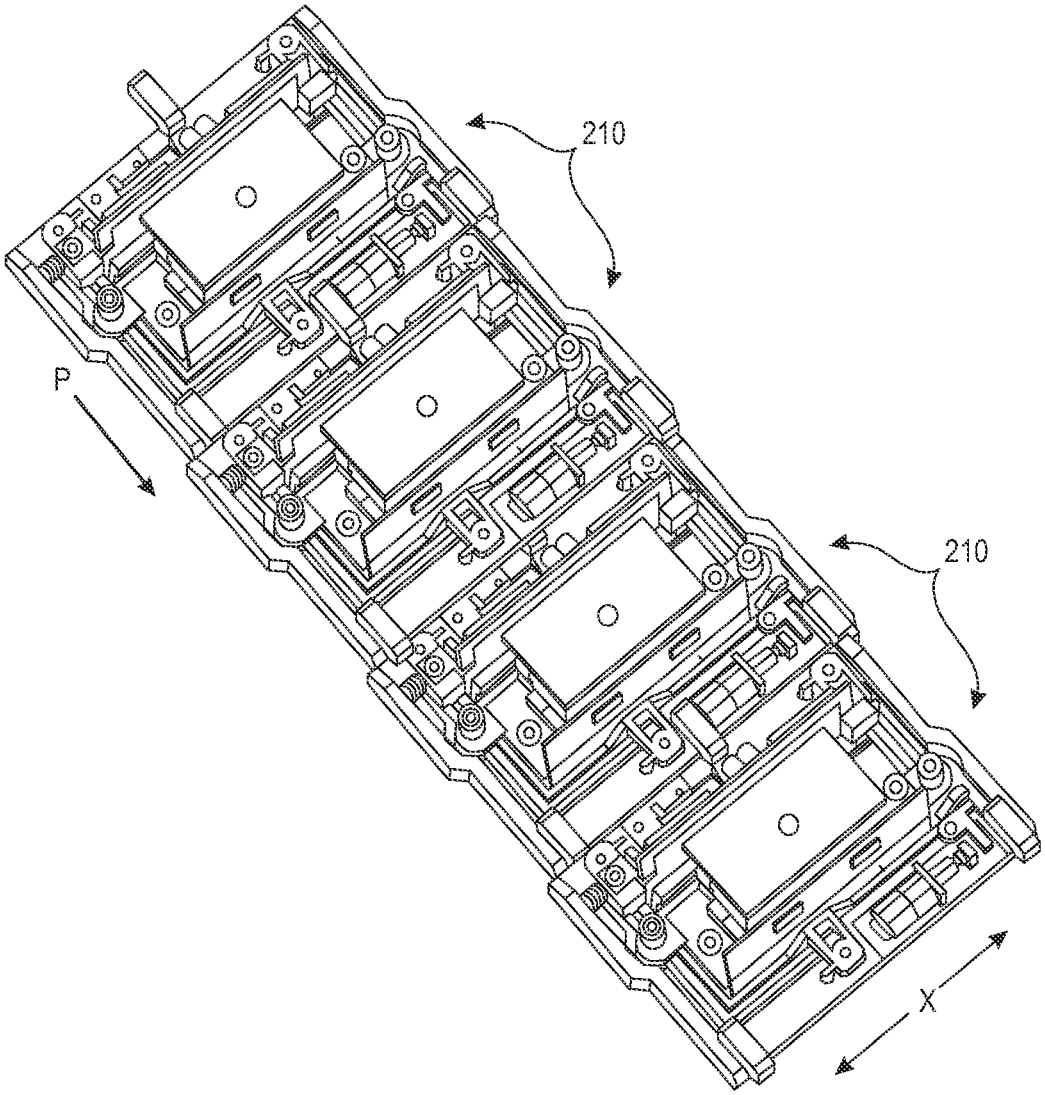
FIG. 10 is a perspective view of another arrangement of printhead assemblies that ca be supported by the print bar assembly of FIG. 1.

An alternative arrangement of assemblies 210 is shown in FIG. 10. In this arrangement, the inkjet ejectors in the printheads are aligned in the process direction Y. The uppermost rod 108 of an assembly 100 passes through one or more flanges 140*c*, depending upon the length of the rod and the number of assemblies positioned adjacent to one another in the cross-process direction X. The lowermost rod 108 of an assembly 100 passes through one or more pairs of flanges 140*a* and 140*b*, depending upon the length of the rod and the number of assemblies positioned adjacent to one another in the cross-process direction X. The remaining rods 108 of the assembly pass through pairs of flanges 140*a* and 140*b*, each flange in each pair being equidistant from a flange 140*c* of an adjacent assembly 210. This arrangement enables rows and columns of assemblies to form a structure that accomplishes what a single printhead would if a single printhead could be constructed on such a scale.

Figure 11:
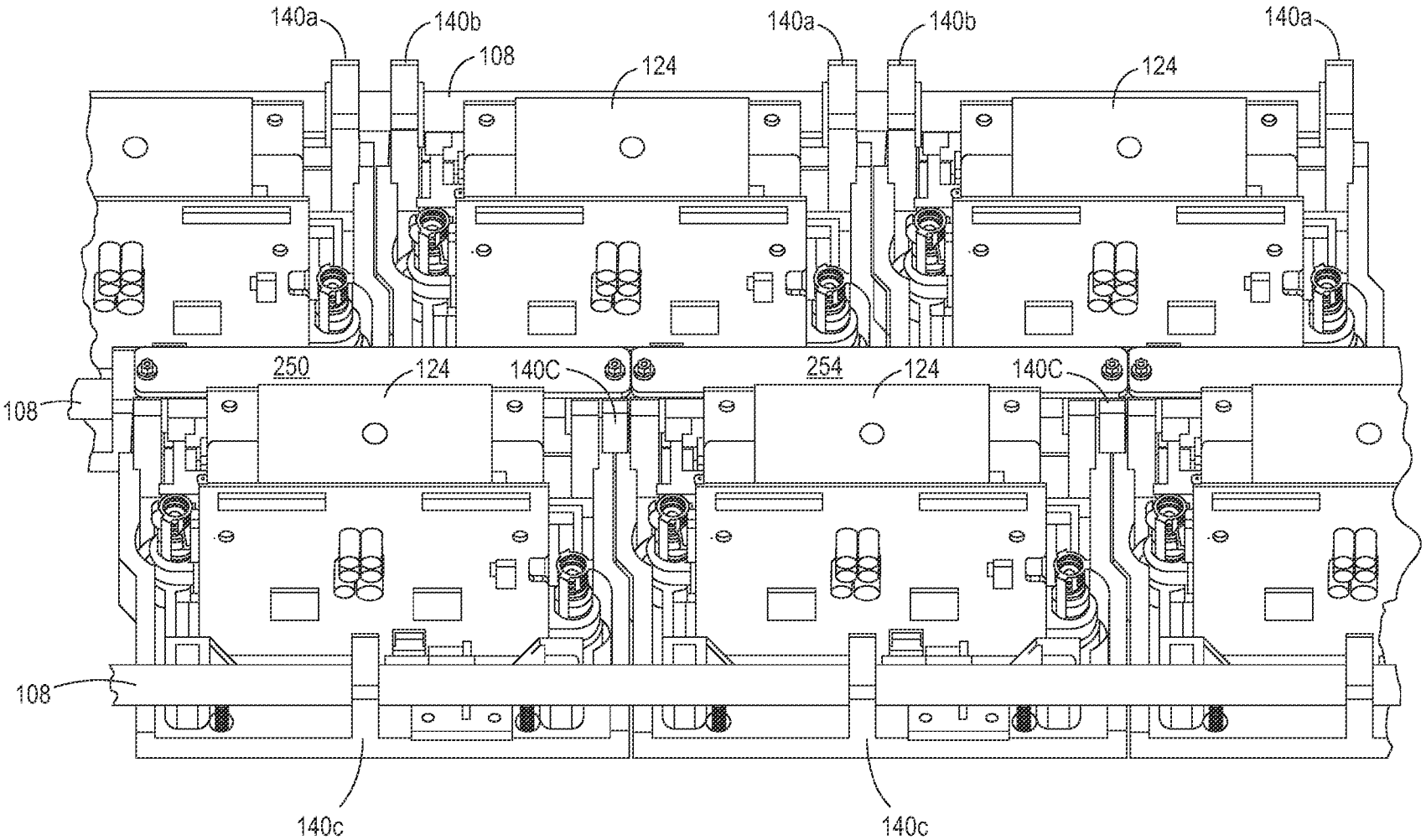
FIG. 11 is a perspective view of a link that conjoins adjacent printhead assemblies in the arrangement shown in FIG. 8.

In printers in which the modular assembly 100 is used for mounting printhead assemblies 210, thermal energy in the print zone can affect the assembly 100. Specifically, rods 108 and the end members 104 can expand if the temperatures of the metals used to form these components reach appropriate temperatures. As the rods expand and lengthen, the assemblies 210 can move with the rods and affect the stitching between printheads. To address the issues arising from these phenomena, a link connects the flanges of adjacent frames. Specifically, as shown in FIG. 11, the printhead labeled "1" is conjoined to the printhead labeled "2" by link 250 and the printhead labeled "3" is conjoined to the printhead labeled "4" by the link 254. To achieve this connection, the flange

140*b* of the printhead labeled "1" receives a screw 258 that traps one end of the link 250 against flange 140*b* and the flange 140*c* of the printhead labeled "2" receives a screw 262 that traps another end of the line 250 against the flange 140*c*. Similarly, link 254 is connected to the printhead labeled "3" and the printhead labeled "4." The links 254 and 258 are made of a material that has a low coefficient of thermal expansion, such as Invar, which is a known nickel-iron alloy. The links and the conjoined frames also affect the movement of other conjoined frames. For example, in FIG. 11, the frames for the printheads labeled "3" and "4," act on the frame for the printhead labeled "2," which is conjoined to the frame for the printhead labeled "1." Thus, the links hold the frames 132 together in their stitched relationship and enable the elongating rods 108 to slide through the slotted bushings 148 in the openings 144 of the flanges through which a rod passes. Consequently, the arrangement of the assemblies 210 on the assembly 100 is relatively immune to the thermal expansion of the assembly 100. Additionally, linking the frames together in this manner enables the two actuators 120 mounted to one of the end frames 104 to push or retract the closest frame 132 to the actuator and the remaining frames in the row corresponding to the actuator 120 respond as well.

In operation, a plurality of rods 108 of different lengths are obtained and end members 104 are fabricated. Printhead plates 128 are mounted to frames 132 with the biasing member 160 and printheads 124 are mounted on the plates 128 with screws 152. The printheads 124 are leveled with screws 172. The printheads 124 are arranged in an appropriate array for the print zone being constructed and rods 108 are passed through flanges of frames 132 to hold the arrangement together. One end member 104 is positioned to receive the ends of the rods at one side of the arrangement and then another end member 104 is positioned to receive the ends of the rods at the opposite side of the assembly 100. The ends of the rods frictionally fit within the linearly arranged receptacles in the end members to enable the end members to be removed from the assembly 100 later. Links, such as links 250 and 254, are mounted to flanges to conjoin adjacent printheads on the assembly 100. The handles 116 of the two end members 104 are used to carry and position the assembly 100 in a printer where the assembly is mounted. The reverse of this procedure can be performed to disassemble the printhead array and install new rods of a different length to enable a different number of printhead assemblies to be arranged for a print zone of another width.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a media transport configured to move media through the printer to form an ink image on the media;

a first member having three linearly arranged receptacles;

a second member having three linearly arranged receptacles;

a first rod, a second rod, and a third rod, each rod having a first end and a second end, the first end of each rod being positioned within one of the receptacles in the first member in a one-to-one correspondence and the second end of each rod being positioned within one of the receptacles in the second member in a one-to-one correspondence to enable the first, the second, and the third rods to extend parallel to one another from the first member to the second member;

a first frame having a perimeter, a pair of flanges extending from a first side of the first frame and a third flange extending from a second side of the first frame, the second side of the first frame being opposite the first side of the first frame, each flange extending from the first frame having a hole in the flange, the first rod passing through the holes in the pair of flanges of the first frame and the second rod passing through the hole in the third flange of the first frame;

a second frame having a perimeter, a pair of flanges extending from a first side of the second frame and a third flange extending from a second side of the second frame, the second side of the second frame being opposite the first side of the second frame, each flange extending from the second frame having a hole in the flange, the third rod passing through the hole in the third flange of the second frame and the second rod passing through the holes in the pair of flanges of the second frame;

a first printhead mounted within the first frame;

a second printhead mounted within the second frame; and a controller operatively connected to the first printhead and the second printhead, the controller being configured to operate the first printhead and the second printhead to form the ink image for the media.

2. The printer of claim 1 wherein the third flange extending from the first frame is adjacent to one flange in the pair of the flanges extending from the second frame to offset inkjets in the first printhead from inkjets in the second printhead by a distance that is less than a distance between the inkjets in the first printhead.

3. The printer of claim 1 wherein the third flange extending from the first frame is equidistant from each flange in the pair of flanges extending from the second frame to align inkjets in the first printhead with inkjets in the second printhead.

4. The printer of claim 1 further comprising:

a slotted bushing in each hole in each flange of the first frame and the second frame.

5. The printer of claim 1 further comprising:

a first plate having an opening, the first printhead being mounted in the opening of the first plate and the first plate being mounted within the perimeter of the first frame; and a second plate having an opening, the second printhead being mounted in the opening of the second plate and the second plate being mounted within the perimeter of the second frame.

6. The printer of claim 5, each frame further comprising:

a plurality of steel pads; and each plate further comprising:

a plurality of threaded members that extend through the plate to engage the plurality of steel pads of the frame in which the plate is positioned in a one-to-one correspondence, the screws being configured to enable the plate to be leveled with reference to the perimeter of the frame in which the plate is positioned.

7. The printer of claim 1 further comprising:

a first biasing member configured to attach to the first plate and to attach to the first frame to bias the first plate into the perimeter of the first frame; and a second biasing member configured to attach to the second plate and to attach to the second frame to bias the second plate into the perimeter of the second frame.

8. The printer of claim 7, each of first frame and the second frame further comprising:

a biasing member positioned between the frame and a portion of the plate positioned within the perimeter of the frame to urge the plate away from the frame in a direction parallel to the perimeter of the frame; and an actuator that is configured to act on the portion of the plate in a direction opposite to the biasing member, but still parallel to the perimeter of the frame to enable the plate to move within a plane parallel to the perimeter of the frame in which the plate is positioned.

9. The printer of claim 7, each frame further comprising:

a pivoting member positioned to rotate about a pivot and engage a portion of the plate positioned within the perimeter of the frame; and an actuator that is configured to act on the pivoting member to apply a rotational force to the pivoting member and the portion of the plate within the perimeter of the frame to rotate the plate within a plane parallel to the perimeter of the frame in which the plate is positioned.

10. The print bar assembly of claim 7 further comprising:

a link operatively connected between the third flange extending from the first frame to one flange in the pair of flanges extending from the second frame, the one flange in the pair of flanges extending from the second frame being the one flange most distance from the third flange extending from the first frame.

11. A print bar assembly comprising:

a first member having three linearly arranged receptacles;

a first actuator mounted to the first member between two of the linearly arranged receptacles and a second actuator mounted to the first member between two of the linearly arranged receptacles, the first actuator and the second actuator not being mounted between the same two linearly arranged receptacles;

a second member having three linearly arranged receptacles;

a first rod, a second rod, and a third rod, each rod having a first end and a second end, the first end of each rod being detachably positioned within one of the receptacles in the first member in a one-to-one correspondence and the second end of each rod being detachably positioned within one of the receptacles in the second member in a one-to-one correspondence to enable the first, the second, and the third rods to extend parallel to one another from the first member to the second member;

a first frame having a perimeter, a pair of flanges extending from a first side of the first frame and a third flange extending from a second side of the first frame, the second side of the first frame being opposite the first side of the first frame, each flange extending from the first frame having a hole in the flange, the first rod passing through the holes in the pair of flanges of the first frame and the second rod passing through the hole in the third flange of the first frame;

a second frame having a perimeter, a pair of flanges extending from a first side of the second frame and a third flange extending from a second side of the second frame, the second side of the second frame being opposite the first side of the second frame, each flange extending from the second frame having a hole in the flange, the third rod passing through the hole in the third flange of the second frame and the second rod passing through the holes in the pair of flanges of the second frame.

12. The print bar assembly of claim 11 wherein the third flange extending from the first frame is adjacent to one flange in the pair of the flanges extending from the second frame.

13. The print bar assembly of claim 11 wherein the third flange extending from the first frame is equidistant from each flange in the pair of flanges extending from the second frame.

14. The print bar assembly of claim 11 further comprising:

a slotted bushing in each hole in each flange of the first frame and the second frame.

15. The print bar assembly of claim 11 further comprising:

a plate having an opening in the plate, the opening being configured to receive a printhead, the plate being configured to fit within the perimeter of the first frame or the perimeter of the second frame.

16. The print bar assembly of claim 11 further comprising:

a biasing member configured to attach to the plate and to attach to the first frame or the second frame in which the plate is positioned to bias the plate into the perimeter of that frame.

17. The print bar assembly of claim 16, each frame further comprising:

a biasing member positioned between the frame and a portion of the plate positioned within the frame to urge the plate away from the frame in a direction parallel to the perimeter of the frame; and an actuator that is configured to act on the portion of the plate positioned within the frame in a direction opposite to the biasing member, but still parallel to the perimeter of the frame to enable the plate to move within the perimeter of the frame in which the plate is positioned.

18. The print bar assembly of claim 16, each frame further comprising:

a plurality of steel pads; and the plate further comprising:

a plurality of threaded members that extend through the plate to engage the plurality of steel pads of the frame in which the plate is positioned in a one-to-one correspondence, the screws being configured to enable the plate to be leveled with reference to the perimeter of the frame in which the plate is positioned.

19. The print bar assembly of claim 16, each frame further comprising:

a pivoting member positioned to rotate about a pivot and engage a portion of the plate positioned within the perimeter of the frame; and an actuator that is configured to act on the pivoting member to apply a rotational force to the pivoting member and the portion of the plate positioned within the frame to rotate the plate within a plane parallel to the perimeter of the frame in which the plate is positioned.

20. The print bar assembly of claim 16 further comprising:

a link operatively connected between the third flange extending from the first frame to one flange in the pair of flanges extending from the second frame, the one flange in the pair of flanges extending from the second frame being the one flange most distance from the third flange extending from the first frame.

* * * * *